US007932803B2

(12) United States Patent
Hirai

(10) Patent No.: US 7,932,803 B2
(45) Date of Patent: Apr. 26, 2011

(54) WIRE-WOUND TYPE COIL AND WINDING METHOD THEREFOR

(75) Inventor: Shinya Hirai, Kasatsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/262,355

(22) Filed: Oct. 31, 2008

(65) Prior Publication Data

US 2009/0045902 A1 Feb. 19, 2009

Related U.S. Application Data

(63) Continuation of application No. PCT/JP2007/071382, filed on Nov. 2, 2007.

(30) Foreign Application Priority Data

Feb. 5, 2007 (JP) ..... 2007-025434

(51) Int. Cl.

| | |
|---|---|
| ***H01F 27/28*** | (2006.01) |
| ***H01F 27/02*** | (2006.01) |
| ***H01F 27/29*** | (2006.01) |
| ***H01F 5/00*** | (2006.01) |
| ***H01F 17/04*** | (2006.01) |
| *H01F 7/06* | (2006.01) |

(52) U.S. Cl. ..... 336/220; 336/83; 336/192; 336/200; 336/221; 336/222; 29/602.1; 29/605

(58) Field of Classification Search ..... None
See application file for complete search history.

(56) References Cited

U.S. PATENT DOCUMENTS

| | | | | |
|---|---|---|---|---|
| 2,930,014 | A * | 3/1960 | van der Hoek et al. | 336/190 |
| 6,965,289 | B2 * | 11/2005 | Toi et al. | 336/83 |
| 7,051,770 | B2 | 5/2006 | Sasaki et al. | |
| 7,201,344 | B2 * | 4/2007 | Higeta | 242/437 |
| 7,209,022 | B2 * | 4/2007 | Kuroiwa et al. | 336/83 |

FOREIGN PATENT DOCUMENTS

| | | | |
|---|---|---|---|
| JP | 02-137206 | A | 5/1990 |
| JP | 09-306769 | A | 11/1997 |
| JP | 2003-100531 | A * | 4/2003 |
| JP | 2003-100531 | A | 4/2003 |
| JP | 2004-63697 | A | 2/2004 |
| JP | 2004-273490 | A | 9/2004 |
| JP | 2006-12989 | A * | 1/2006 |
| JP | 2006-80434 | A | 3/2006 |
| JP | 2006-121013 | A | 5/2006 |

OTHER PUBLICATIONS

Official Communication issued in International Patent Application No. PCT/JP2007/071382, mailed on Feb. 5, 2008.

* cited by examiner

*Primary Examiner* — Anh T Mai
*Assistant Examiner* — Mangtin Lian
(74) *Attorney, Agent, or Firm* — Keating & Bennett, LLP

(57) ABSTRACT

A common-mode choke coil includes a magnetic core, external electrodes, first and second wires, and a magnetic top. The magnetic core includes a winding core section and first and second flange sections. The external electrodes are provided on the first and second flange sections. The first wire is directly wound around the winding core section. The second wire is wound around the outside of the first wire. The first turn of the second wire is wound while being in contact with the first turn of the first wire and the first flange section.

2 Claims, 8 Drawing Sheets

WIRE-WOUND TYPE COIL AND WINDING METHOD THEREFOR

BACKGROUND OF THE INVENTION

1. Field of the Invention

The present invention relates to a wire-wound type chip coil in which two wires are wound around a core and to a winding method therefor.

2. Description of the Related Art

A common-mode choke coil disclosed in Japanese Unexamined Patent Application Publication No. 2006-121013 is an example of a common-mode choke coil according to the related art. This common-mode choke coil has a configuration in which, after a first wire is wound around a winding core section and both of its ends are fixed on flange sections at both ends of the winding core section, a second wire is wound over the first wire and both of its ends are fixed on the flange sections.

With this configuration, a differential signal on a differential-transmission line is transmitted and an intruding common-mode noise is removed.

Another coil unit according to the related art is disclosed in Japanese Unexamined Patent Application Publication No. 2005-166935. Unlike Japanese Unexamined Patent Application Publication No. 2006-121013, this wire-wound type coil is formed by simultaneously winding a first wire and a second wire in pairs around a winding core section.

However, the above-described related-art wire-wound type coils have the problems described below.

FIG. 13 is a schematic cross-sectional view to describe a problem in the wire-wound type coil according to Japanese Unexamined Patent Application Publication No. 2006-121013. FIG. 14 is a schematic cross-sectional view to describe a problem existing in the wire-wound type coil according to Japanese Unexamined Patent Application Publication No. 2005-166935. A first wire is represented by a black circle, and a second wire is represented by a white circle. In FIG. 14, the numeral in each of the black and white circles represents the number of the turn of the wire corresponding to the circle.

For a wire-wound type coil 100 as shown in FIG. 13, after a first wire 121 is directly wound around a winding core section 111 of a core 110 from the side adjacent to a flange section 112 toward the side adjacent to a flange section 113, as indicated by the black circles in FIG. 13, a second wire 122 is wound over the first wire 121, as indicated by the white circles in FIG. 13. Because the same winding operation must be performed twice, the productivity is reduced.

Furthermore, because the second wire 122 is wound on top of the first wire 121, the wire-wound type coil 100 has a winding structure in which a wire portion 122-1 of the first turn of the second wire 122 is disposed between a wire portion 121-1 of the first turn of the first wire 121 and a wire portion 121-2 of the second turn of the first wire 121. Thus, a wire portion **122-*n* of the second wire 122 of the last turn is not disposed on top of the first wire 121 and has to be wound directly around the winding core section 111. That is, the wire portion 122-*n* of the last turn of the second wire 122** suffers from a phenomenon in which it is arranged below a layer in which it should be disposed (hereinafter, this phenomenon is referred to as a layer-down). If such a layer-down occurs, when a predetermined differential signal is input, the noise power ratio for output noise may be increased, such that the noise reducing effect is decreased.

Moreover, such a layer-down must sacrifice the number of turns of the coil by the amount of the last turn. Thus, the number of turns cannot be sufficiently increased, and the range of an obtainable inductance value is reduced.

For a wire-wound type coil 150 as illustrated in FIG. 14, after a first wire 121 and a second wire 122 are wound side by side around a winding core section 111, the first wire 121 and the second wire 122 are simultaneously wound such that the second turn of the first wire 121 is arranged downstream of the first turn of the second wire 122 and such that the second turn of the second wire 122 is disposed on top of the first turn of the first wire 121 and that of the second wire 122. The third and subsequent turns are also wound similarly to the second turn.

Accordingly, with such a winding method, the distance d between the first wire 121 and the second wire 122 at the second and subsequent turns is greater than necessary, such that the wire-wound type coil 150 is unbalanced as a coil. Because of this, the magnetic coupling between the first and second wires 121 and 122 may be decreased, mode conversion into noise may occur, and a noise reducing effect may not be obtainable.

SUMMARY OF THE INVENTION

To overcome the problems described above, preferred embodiments of the present invention provide a wire-wound type coil that provides a desired magnetic coupling between two simultaneously wound wires and that also has a winding configuration that does not cause any layer-down, and a winding method therefor.

A preferred embodiment of the present invention provides a wire-wound type coil including a core having a winding core section and first and second flange sections disposed at both ends of the winding core section, an external electrode provided on each of the first and second flange sections, and first and second wires wound around the winding core section from a side adjacent to the first flange section toward a side adjacent to the second flange section, each of the first and second wires having an end section that extends to the external electrode and is bonded thereto. The first wire is directly wound around the winding core section. The second wire is wound around an outside of the first wire such that a wire portion of the first turn of the second wire is arranged closer to the first flange section than a wire portion of the first turn of the first wire and is in contact with both the first flange section and the wire portion of the first turn of the first wire. A wire portion of the last turn of the first wire and a wire portion of the last turn of the second wire terminate before the second flange section without being in contact with the second flange section, and an end section of each of the wire portions of the last turns extends to and is bonded to the external electrode on the second flange section.

With this configuration, when the external electrode is connected to a differential-signal transmission line and a differential signal is input, the differential signal input from the external electrode on the first flange section is transmitted through the first and second wires wound around the winding core section and is output to the external electrode on the second flange section.

At this time, because the wire portion of the first turn of the second wire is wound while being arranged closer to the first flange section than the wire portion of the first turn of the first wire is and being in contact with the first flange section and the wire portion of the first turn of the first wire, the first and second wires are wound such that the first and second wires are in contact with each other at every turn. Thus, as compared to the wire-wound type coil disclosed in Japanese Unexamined Patent Application Publication No. 2005-166935, the distance between the first and second wires at each turn is uniformly less and the magnetic coupling between the first and second wires is increased. As a result, the wire-wound type coil according to preferred embodiments of the present invention provides an improved noise reduction effect.

With such a configuration, the wire portion of the last turn of the second wire is arranged closer to the first flange section than the wire portion of the last turn of the first wire is, and all of the wire portions of the second wire are wound around the outside of the first wire without suffering from a layer-down. As a result, an input differential signal is output without being mode-converted to noise.

Another preferred embodiment of the present invention provides a method of winding a wire-wound type coil including a core having a winding core section and first and second flange sections disposed at both ends of the winding core section and an external electrode provided on each of the first and second flange sections. The method includes winding the first and second wires around the winding core section of the wire-wound type coil from a side adjacent to the first flange section toward a side adjacent to the second flange section and bonding an end section of each of the first and second wires to the external electrode. The first and second wires are simultaneously wound around the winding core section such that the first wire is directly wound around the winding core section and the second wire is wound around an outside of the first wire.

With such a configuration, because it is not necessary to repeat the winding step, unlike the method described in Japanese Unexamined Patent Application Publication No. 2006-121013, and the first and second wires can be simultaneously wound around the winding core section at one time, the manufacturing time can be significantly reduced.

Preferably, the first and second wires may be simultaneously wound around the winding core section such that a wire portion of the first turn of the second wire is arranged closer to the first flange section than a wire portion of the first turn of the first wire is and is in contact with both the first flange section and the wire portion of the first turn of the first wire.

With such a configuration, the first and second wires at each turn can be simultaneously wound around the winding core section while being in close contact with each other. Thus, the wire-wound type coil having strong magnetic coupling between the first and second wires and not including any layer-down in which the second wire is disposed below the first wire is provided. Because no layer-down occurs, the number of turns of the wires can be increased.

Another preferred embodiment of the present invention provides a method of winding a wire-wound type coil including a core having a winding core section and first and second flange sections disposed at both ends of the winding core section and an external electrode formed on each of the first and second flange sections. The method includes winding the first and second wires around the winding core section of the wire-wound type coil from a side adjacent to the first flange section toward a side adjacent to the second flange section and bonding an end section of each of the first and second wires to the external electrode. The first wire is directly wound around the winding core section from the side adjacent to the first flange section toward the side adjacent to the second flange section. The second wire is wound around an outside of the first wire such that a wire portion of the first turn of the second wire is arranged closer to the first flange section than a wire portion of the first turn of the first wire is and is in contact with both the first flange section and the wire portion of the first turn of the first wire.

As described in detail above, because the wire-wound type coil according to preferred embodiments of the present invention is configured such that the first and second wires at each turn are in close contact with each other and are wound without suffering from a layer-down, an input differential signal is not significantly mode-converted to noise. As a result of this, the advantages of reducing the noise power ratio for output power and improving the noise reduction effect are achieved.

With the method for winding a wire-wound type coil according to preferred embodiments of the present invention, the manufacturing time is significantly reduced. As a result, an advantage of improved productivity for the wire-wound type coils is provided.

With the method for winding a wire-wound type coil according to preferred embodiments of the present invention, the wire-wound type coil having an enhanced noise reduction effect is provided. Because the number of turns of the wires can be increased due to no layer-down, an advantage of increasing the range of an obtainable inductance value is provided.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the drawings.

First Preferred Embodiment

Figure 1:
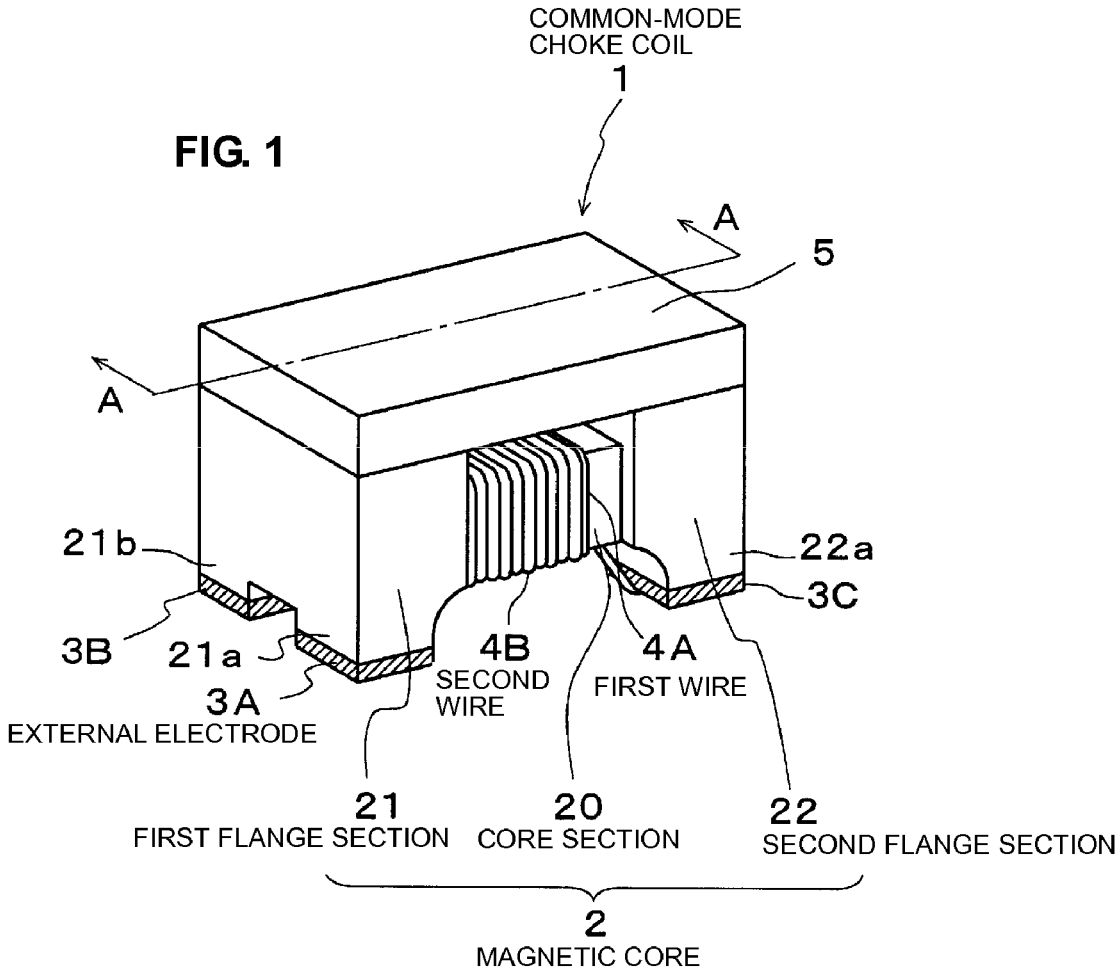
FIG. 1 is a perspective view of a wire-wound type coil according to a preferred embodiment of the present invention.
Figure 2:
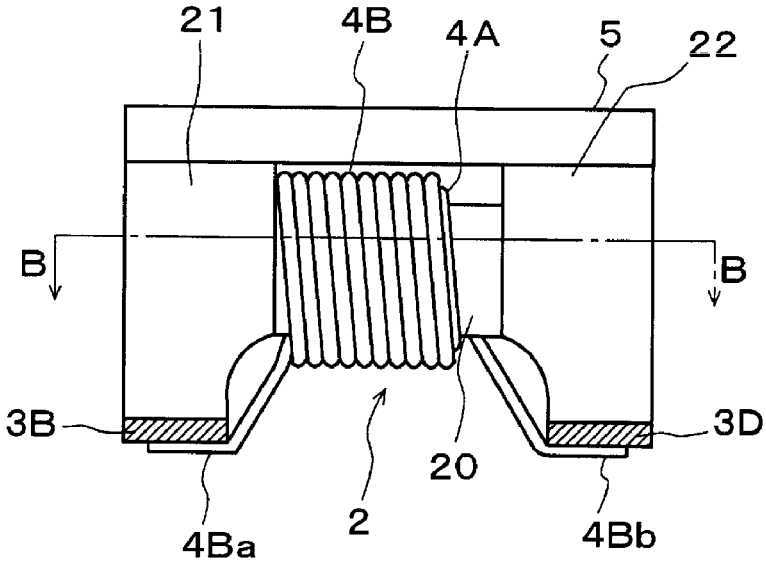
FIG. 2 is a cross-sectional view taken along the arrowed line A-A of FIG. 1.
Figure 3:
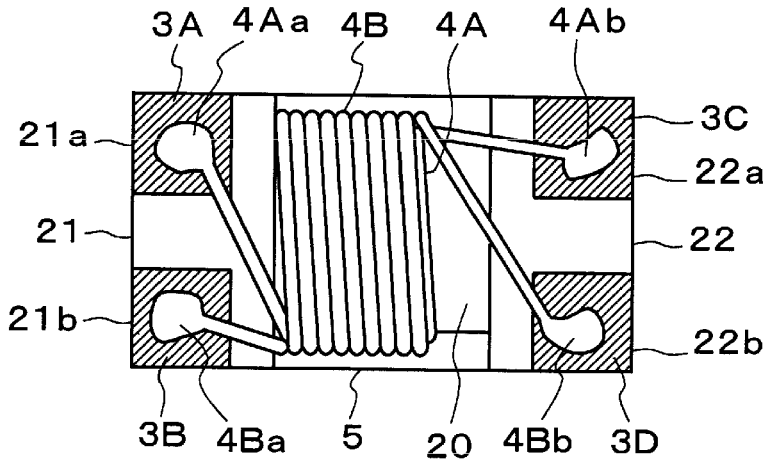
FIG. 3 is a plan view that illustrates a bottom of the wire-wound type coil shown in FIG. 1.

FIG. 1 is a perspective view illustrating a wire-wound type coil according to a preferred embodiment of the present invention. FIG. 2 is a cross-sectional view taken along the arrowed line A-A of FIG. 1. FIG. 3 is a plan view that illustrates a bottom.

A wire-wound type coil according to the present preferred embodiment is a surface-mountable common-mode choke coil, and, as illustrated in FIGS. 1 and 2, includes a magnetic core 2, four external electrodes 3A to 3D, first and second wires 4A and 4B, and a magnetic top 5.

As illustrated in FIG. 1, the magnetic core 2 includes a winding core section 20 at a central portion and first and second flange sections 21 and 22 at both ends.

The external electrodes 3A to 3D are disposed on the lower portion of the first and second flange sections 21 and 22.

Specifically, as illustrated in FIG. 3, the external electrodes 3A and 3B are disposed on leg sections 21*a* and 21*b*, respectively, and the external electrodes 3C and 3D are disposed on leg sections 22*a* and 22*b*, respectively.

Each of the first and second wires 4A and 4B preferably is a line made of a copper line covered with an insulating film and, as illustrated in FIG. 2, is wound around the winding core section 20 of the magnetic core 2 from the side adjacent to the first flange section 21 toward the side adjacent to the second flange section 22. As illustrated in FIG. 3, an end section 4Aa of the first wire 4A and an end section 4Ba of the second wire 4B extend to the external electrodes 3A and 3B and are bonded to the external electrodes 3A and 3B, respectively, and an end section 4Ab of the first wire 4A and an end section 4Bb of the second wire 4B extend to the external electrodes 3C and 3D and bonded to the external electrodes 3C and 3D, respectively.

The common-mode choke coil 1 according to the present preferred embodiment features the winding structure of the first and second wires 4A and 4B.

Figure 4:
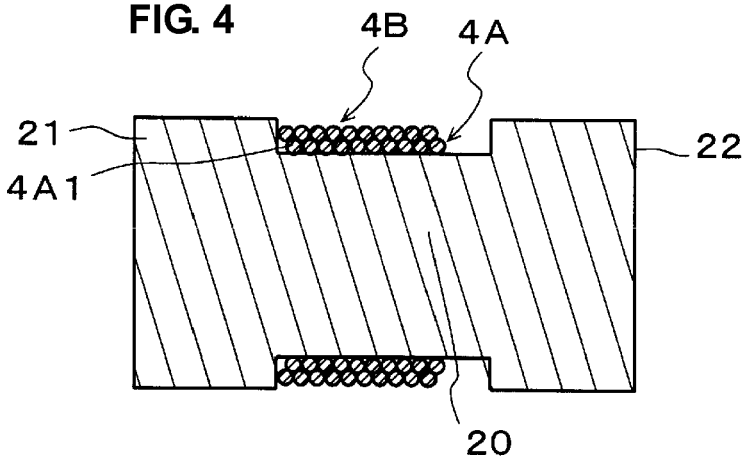
FIG. 4 is a cross-sectional view taken along the arrowed line B-B of FIG. 2.
Figure 5:
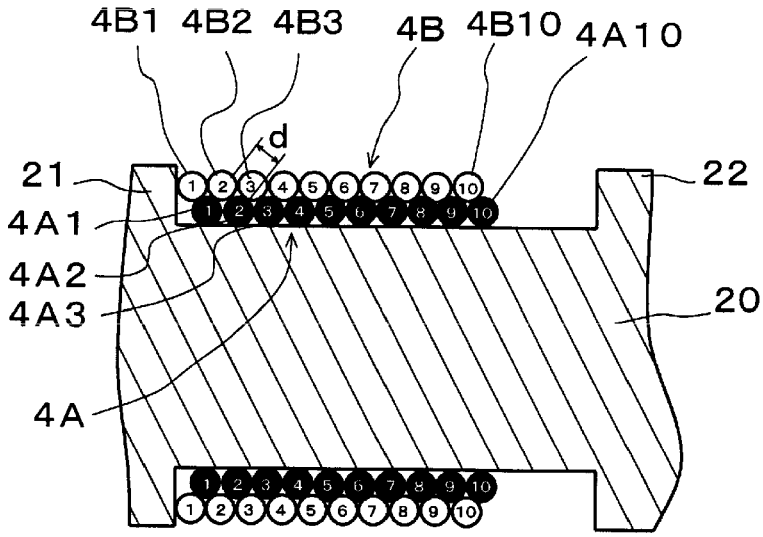
FIG. 5 is an enlarged fragmentary schematic view to describe a winding configuration of a common-mode choke coil.

FIG. 4 is a cross-sectional view taken along the arrowed line B-B of FIG. 2. FIG. 5 is a fragmentary enlarged schematic view describing the winding configuration of the common-mode choke coil 1. To facilitate understanding, a cross section of the first wire 4A is represented by a black circle, and a cross section of the second wire 4B is represented by a white circle. In FIG. 5, the numeral in each of the black and white circles represents the number of the turn of the wire corresponding to the circle.

As illustrate FIG. 4, the first wire 4A is directly wound around the winding core section 20 toward the second flange section 22 such that a wire portion 4A1 of the first turn is arranged adjacent to the first flange section 21. The second wire 4B is wound around the outside of this first wire 4A.

Specifically, as illustrated in FIG. 5, a wire portion 4B1 of the first turn of the second wire 4B is closer to the first flange section 21 than the wire portion 4A1 of the first turn of the first wire 4A is. This wire portion 4B1 of the first turn is wound while being pressed in contact with the wire portion 4A1 of the first turn of the first wire 4A and also pressed in contact with the inner surface of the first flange section 21.

Figure 13:
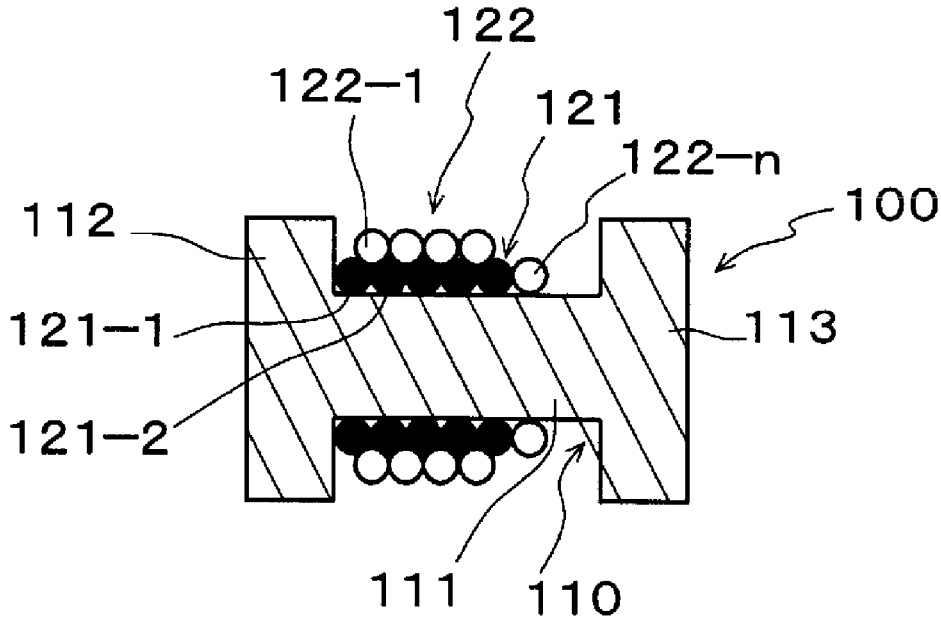
FIG. 13 Prior Art
FIG. 13 is a schematic cross-sectional view describing a problem existing in a wire-wound type coil according to a related art example.
Figure 14:
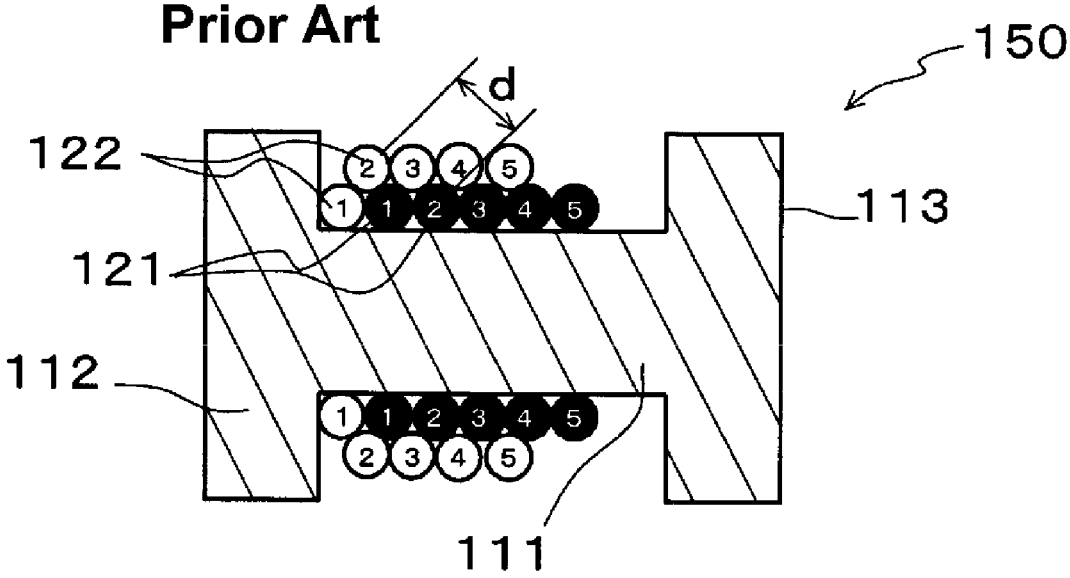
FIG. 14 Prior Art
FIG. 14 is a schematic cross-sectional view describing a problem existing in a wire-wound type coil according to another related art example.

In this manner, because the winding of the second wire 4B starts from a location before the first wire 4A (a position closer to the first flange section 21), a wire portion 4B2 of the second turn is close to a wire portion 4A2 of the second turn and is in contact with the upper side thereof. That is, the wire portions 4A2 and 4B2 of the second turn are in contact with each other with a small center-to-center spacing of d. Wire portions 4A3 to 4A10 and 4B3 to 4B10 of the third and subsequent turns are also uniformly in contact with the center-to-center spacing of d. Thus, unlike the wire-wound type coil shown in FIG. 13, because the wire portions 4A1 to 4A10 and 4B1 to 4B10 of all turns are uniformly in close contact, the magnetic coupling between the wires is very well balanced.

With this winding configuration, the wire portion 4B10 of the last turn of the second wire 4B is also disposed before the wire portion 4A10 of the last turn of the first wire 4A. That is, unlike the wire-wound type coil shown in FIG. 13, the wire portion 4B10 of the last turn is wound while being reliably disposed on top of the first wire 4A without having a layer-down.

The wire portions 4A10 and 4B10 of the last turns of the first and second wires 4A and 4B terminate before the second flange section 22 and are not in contact with the second flange section 22. In this state, as illustrated in FIG. 3, the end sections 4Ab and 4Bb of the wire portions 4A10 and 4B10 of the last turns of the first and second wires 4A and 4B extend to and are bonded to the external electrodes 3C and 3D, respectively, on the second flange section 22.

The magnetic top 5 illustrated in FIG. 1 is disposed over the top surfaces of the first and second flange sections 21 and 22 and is bonded to the top surfaces of the first and second flange sections 21 and 22 with an adhesive (not shown).

Next, a method of making the common-mode choke coil 1 according to the present preferred embodiment will be described.

Figure 6:
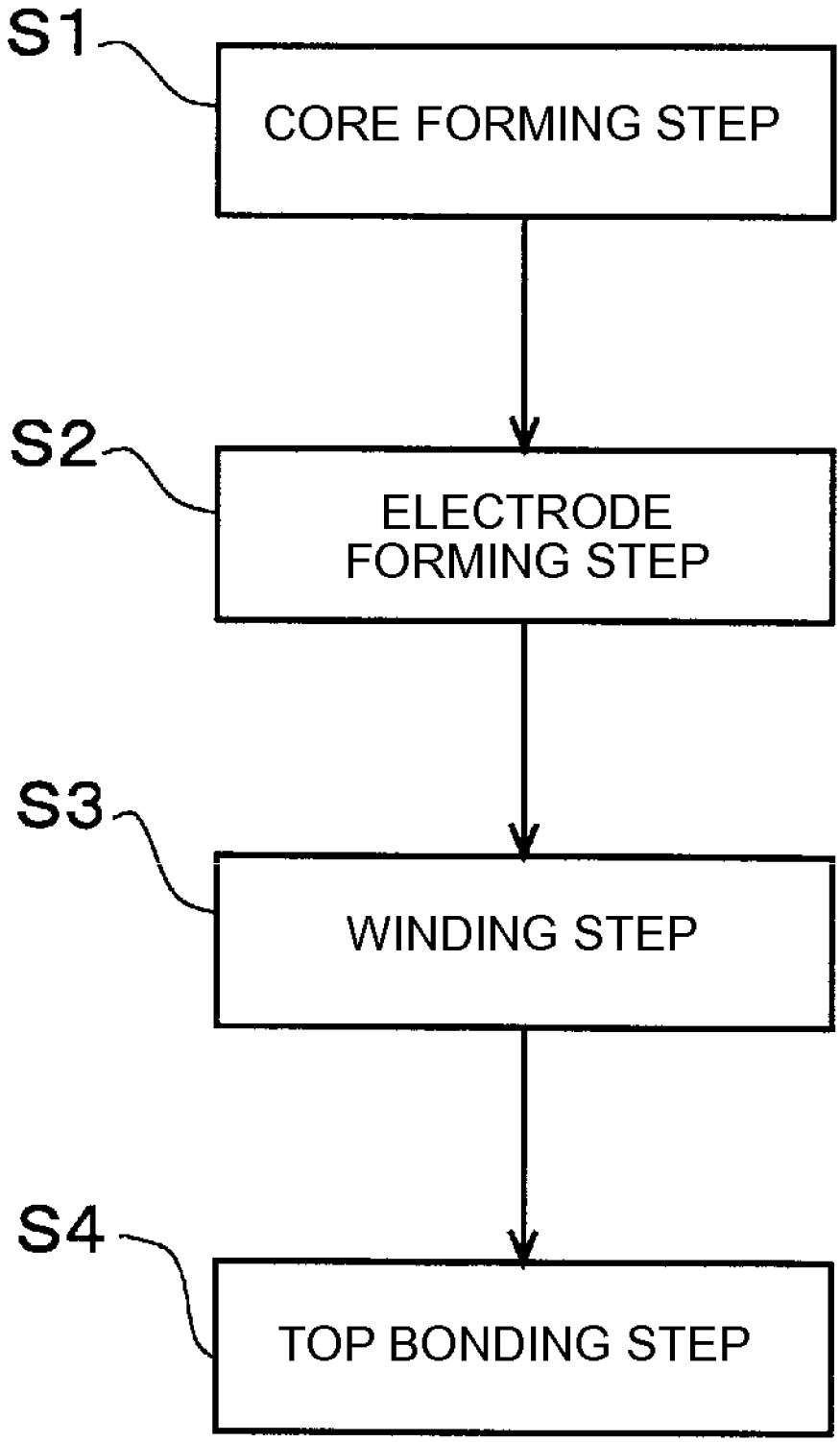
FIG. 6 is a process chart illustrating a method of making a common-mode choke coil according to a preferred embodiment of the present invention.

FIG. 6 is a process chart that illustrates a method of making the common-mode choke coil 1 according to the present preferred embodiment.

As illustrated in FIG. 6, the method includes a core forming step S1, an electrode forming step S2, a winding step S3, and a top bonding step S4.

The core forming step S1 is the step of forming the magnetic core 2 of the common-mode choke coil 1.

Figure 7A:
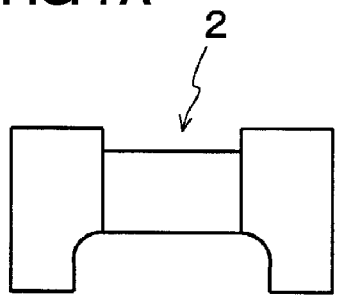
FIGS. 7A and 7B are front views describing a core forming step and an electrode forming step.
Figure 7B:
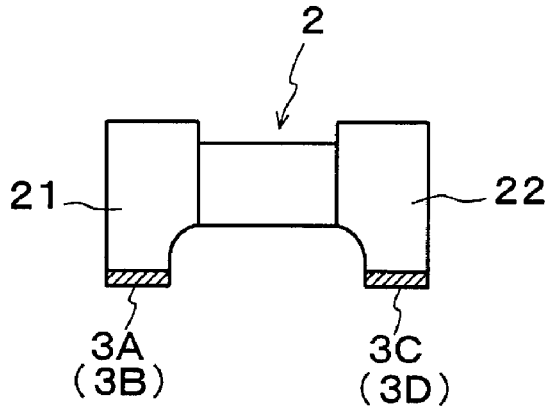

FIGS. 7A and 7B are front views showing the core forming step S1 and the electrode forming step S2.

As illustrated in FIG. 7A, in the core forming step S1, a magnetic substance is shaped and sintered, thereby forming the magnetic core 2 including the winding core section 20 and the first and second flange sections 21 and 22.

The electrode forming step S2 is the step of forming the external electrodes 3A to 3D on the lower portions of the first and second flange sections 21 and 22 of the magnetic core 2, as illustrated in FIG. 7B. Preferably, silver paste or other suitable paste, for example, is processed on the leg sections 21*a*, 21*b*, 22*a*, and 22*b* of the first and second flange sections 21 and 22 by dipping to form a film, and wet plating is applied to the surface of the film to form a nickel or other suitable plating layer, for example, thereby forming the external electrodes 3A to 3D.

The winding step S3 is the step of winding the first and second wires 4A and 4B around the winding core section 20 of the magnetic core 2 and includes a step of positioning the start of winding, a step of simultaneously winding, and a step of bonding wires.

Figure 8:
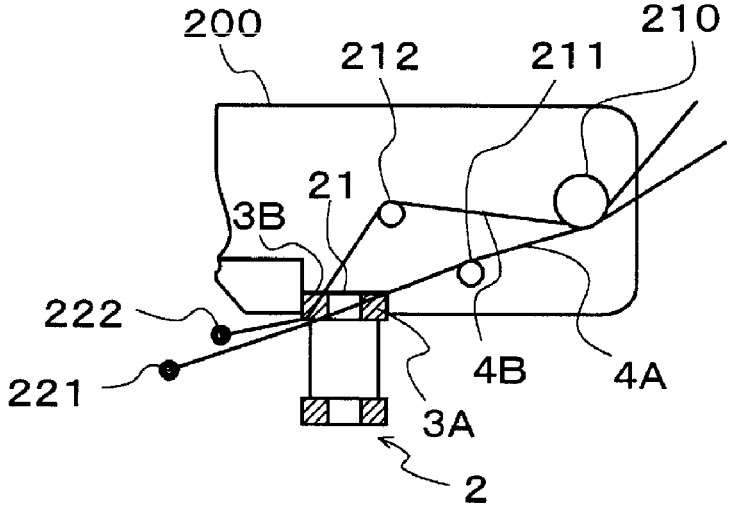
FIG. 8 is a schematic plan view illustrating an operation of positioning the start of winding.
Figure 9:
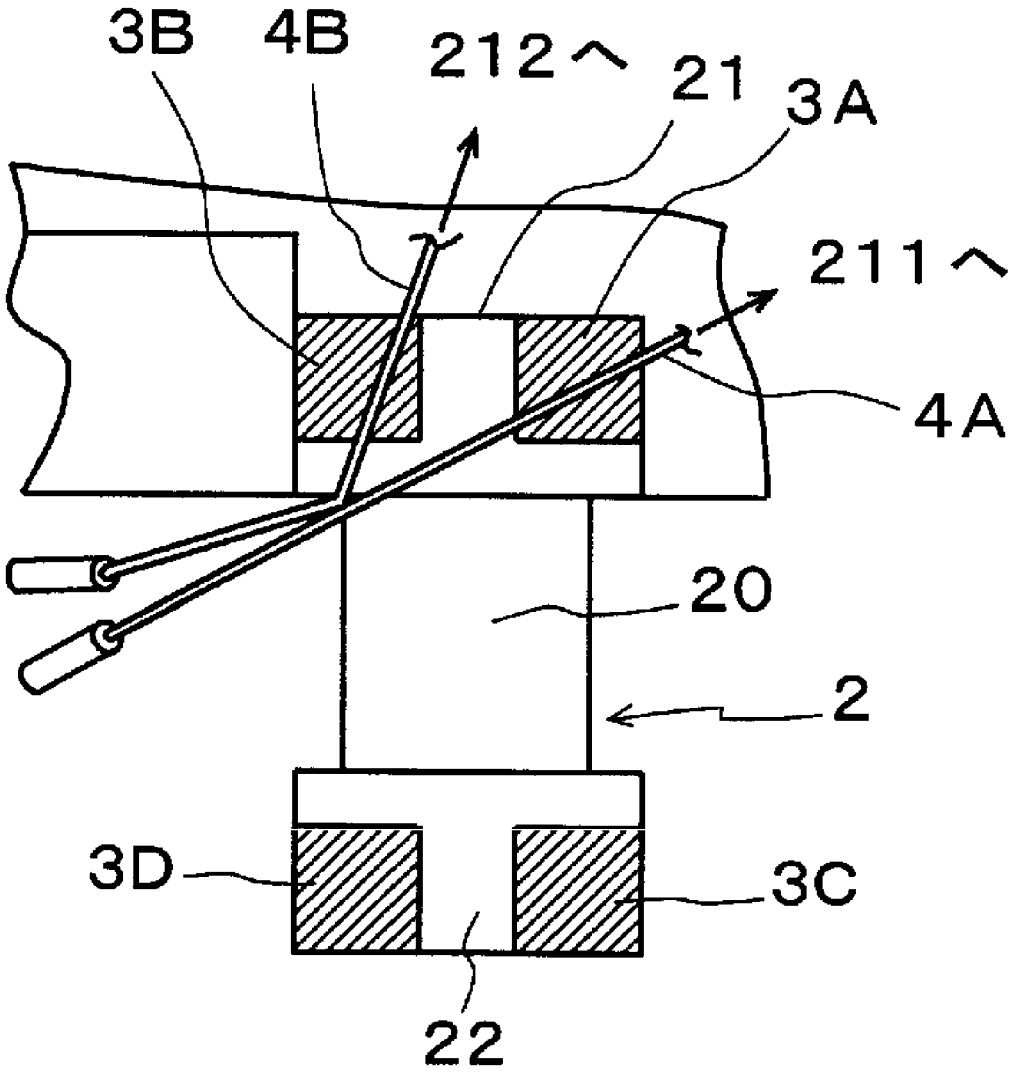
FIG. 9 is a fragmentary enlarged view of FIG. 8.

FIG. 8 is a schematic plan view illustrating the operation of positioning the start of winding. FIG. 9 is a fragmentary enlarged view of FIG. 8.

As illustrated in FIG. 8, in the operation of positioning the start of winding the first and second wires 4A and 4B, the first wire 4A and the second wire 4B are unwound from nozzles 221 and 222, respectively, and are held by a wire chuck 210, then the first wire 4A and the second wire 4B are caught by guide pins 211 and 212 by independent movement of the nozzles 221 and 222, and then the first wire 4A and the second wire 4B are guided to the magnetic core 2 held by a winding jig 200.

Then, the first wire 4A and the second wire 4B are positioned over the external electrodes 3A and 3B so as to be engaged with the first flange section 21 of the magnetic core 2. Thereafter, the first wire 4A is in contact with the winding core section 20 of the magnetic core 2 and is arranged in the vicinity of the first flange section 21 by independent movement of the nozzles 221 and 222, as illustrated in FIG. 9. The second wire 4B is in contact with the upper side of the first wire 4A and is in contact with the inner surface of the first flange section 21. That is, as illustrated in FIG. 5, the wire portion 4B1 of the first turn of the second wire 4B is arranged closer to the first flange section 21 than the wire portion 4A1 of the first turn of the first wire 4A is. The first and second wires 4A and 4B are arranged such that the wire portion 4B1 of the first turn is in contact with the wire portion 4A1 of the first turn of the first wire 4A and the inner surface of the first flange section 21.

In this state, the operation of simultaneously winding the first and second wires 4A and 4B is performed.

Figure 10A:
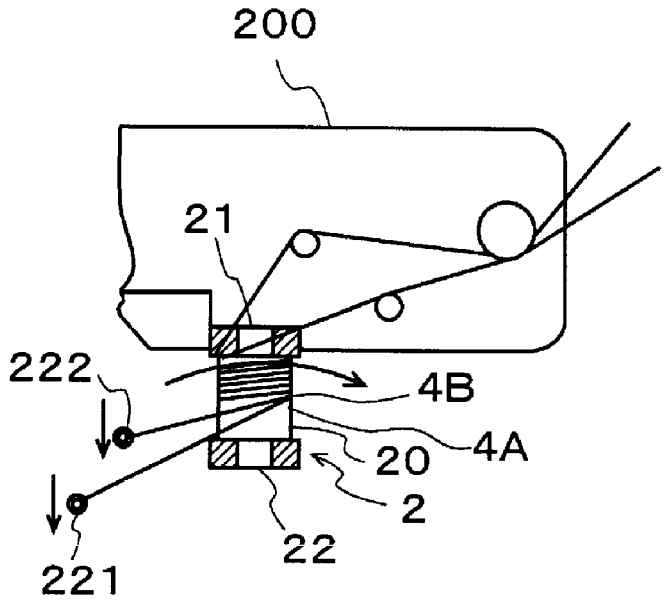
FIGS. 10A and 10B are schematic plan views illustrating an operation of simultaneously winding wires.
Figure 10B:
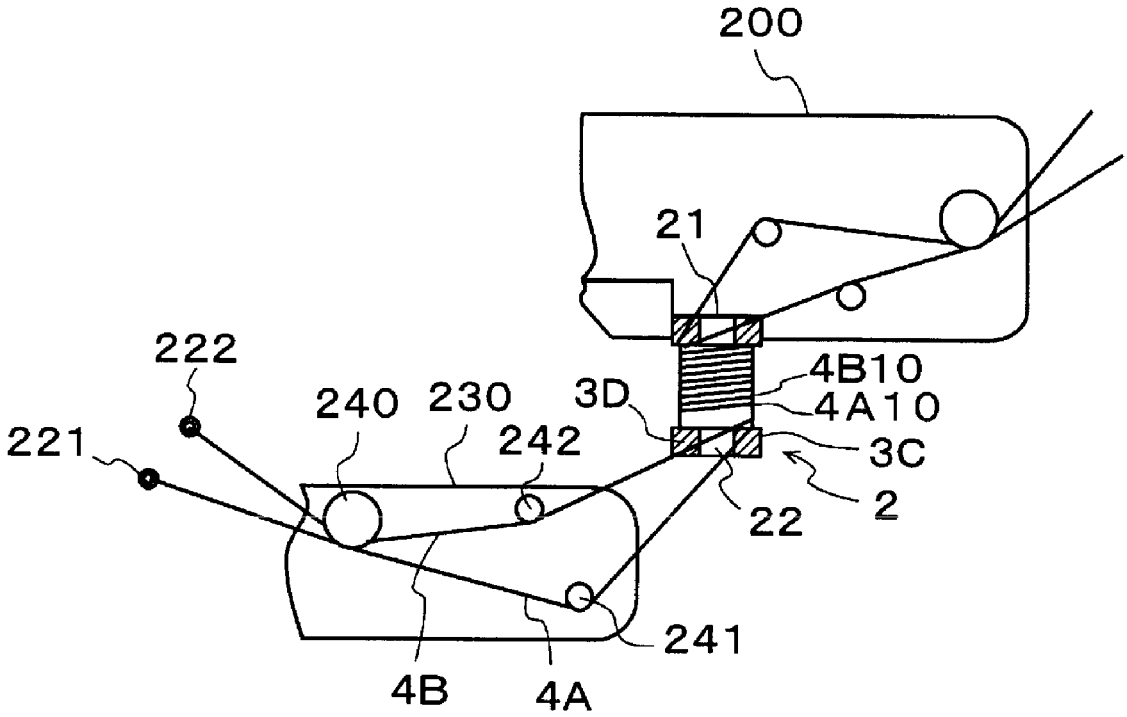

FIGS. 10A and 10B are schematic plan views illustrating the operation of simultaneously winding wires.

As illustrated in FIG. 10A, the magnetic core 2 is rotated together with the winding jig 200 in the direction indicated by the arrows, the first and second wires 4A and 4B are simultaneously wound side-by-side around the winding core section 20 of the magnetic core 2 and such that the second wire 4B comes into contact with the upper side of the first wire 4A. At this time, the nozzles 221 and 222 are moved in the direction of the central axis of the magnetic core 2 (downward in the drawing) as the winding advances.

In this manner, by moving the nozzles 221 and 222, the first and second wires 4A and 4B are wound around the winding core section 20 from the side adjacent to the first flange section 21 toward the side adjacent to the second flange section 22 so as to have no spacing therebetween. This enables the lower first wire 4A to be directly wound around the winding core section 20 and the second wire 4B to be wound around the outside of the first wire 4A while being in contact with the first wire 4A, as illustrated in FIG. 5. Further, the wire portion 4B1 of the first turn of the second wire 4B is arranged closer to the first flange section 21 than the wire portion 4A1 of the first turn while being in contact with the wire portion 4A1 of the first turn of the first wire 4A and the first flange section 21.

As illustrated in FIG. 10B, when the wire portions 4A10 and 4B10 of the last turns of the first and second wires 4A and 4B are in front of the second flange section 22, the rotation of the winding jig 200 is stopped, and the nozzles 221 and 222 are also moved such that the first and second wires 4A and 4B are engaged with the second flange section 22. In addition, the first and second wires 4A and 4B are caught by guide pins 241 and 242, respectively, of an arm 230 by moving of the nozzles 221 and 222. At this time, the first and second wires 1 and 2 are set and arranged so as to overlap the external electrodes 3C and 3D on the second flange section 22.

In this manner, winding the first and second wires 4A and 4B to the last turns enables the first and second wires 4A and 4B to be very well balanced while the first and second wires 4A and 4B are in close contact with each other, as illustrated in FIG. 5.

The wire portion 4B10 of the last turn of the second wire 4B is arranged in front of the wire portion 4A10 of the last turn of the first wire 4A (adjacent to the first flange section 21), and the wire portion 4B10 of the last turn is wound on top of the first wire 4A without having a layer-down.

In this state, the operation of bonding wires is performed.

The first and second wires 4A and 4B are bonded to the external electrodes 3A to 3D.

Figure 11:
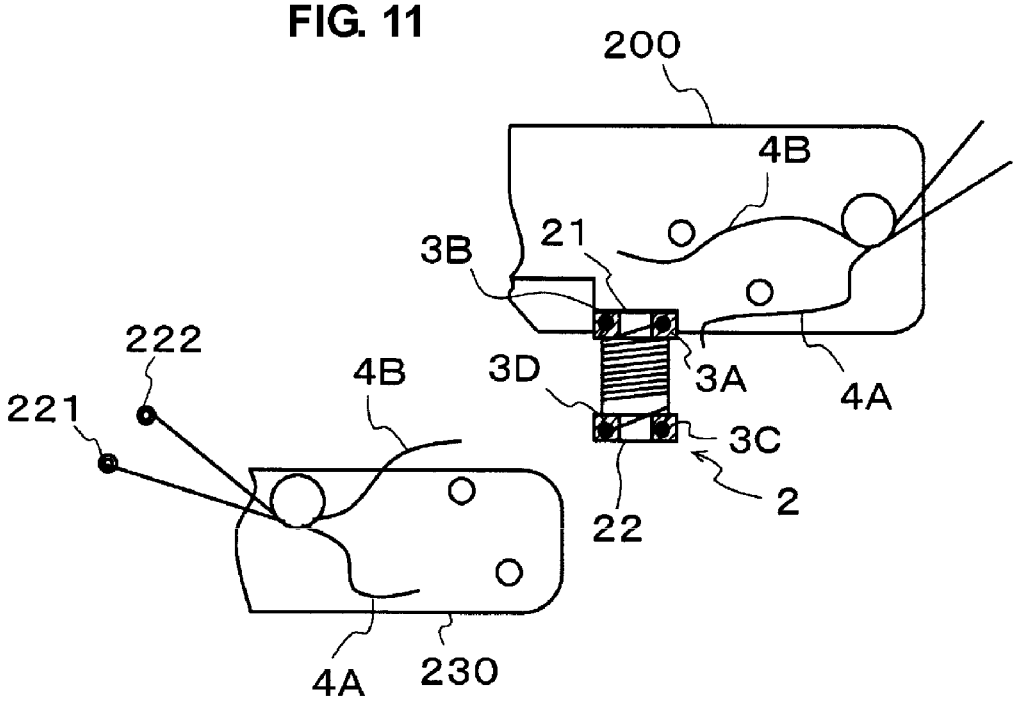
FIG. 11 is a schematic plan view illustrating an operation of bonding wires.

FIG. 11 is a schematic plan view that illustrates the operation of bonding wires.

As illustrated in FIG. 11, in the operation of winding wires, a portion of the first and second wires 4A and 4B in contact with the external electrodes 3A and 3B on the first flange section 21 (the portion corresponding to the end sections 4Aa and 4Ba shown in FIG. 3) and a portion of the first and second wires 4A and 4B in contact with the external electrodes 3C and 3D on the second flange section 22 (the portion corresponding to the end sections 4Ab and 4Bb in FIG. 3) are deposited by, for example, thermocompression bonding and are fixed on the external electrodes 3A to 3D. Thereafter, the first and second wires 4A and 4B are cut at the external electrodes 3A to 3D, thereby obtaining the common-mode choke coil 1 in which the end sections 4Aa, 4Ba, 4Ab, and 4Bb of the first and second wires 4A and 4B are bonded to the external electrodes 3A, 3B, 3C, and 3D, respectively, as shown in FIG. 3.

Thus, the use of the winding step S3 described above eliminates the necessity to repeat the same step, and the first and second wires 4A and 4B can be simultaneously wound around the winding core section 20 of the winding core section 20 at the same time. The manufacturing time is thus significantly reduced. As a result, the productivity of producing the common-mode choke coils 1 is greatly improved.

Because the first and second wires 4A and 4B can be wound in close contact with each other while being very well balanced, the magnetic coupling between the wires is improved. Thus, the common-mode choke coil 1 having no mode conversion and exhibiting a favorable noise reduction function is obtained.

Because the wire portion 4B10 of the last turn of the second wire 4B can be wound on top of the first wire 4A without having a layer-down, the common-mode choke coil 1 having improved characteristics can be manufactured. Because no layer-down exists, the number of turns of the first and second wires 4A and 4B can be increased by at least one turn. As a result, the common-mode choke coil 1 having a desired inductance value can be obtained.

The top bonding step S4 is the step of bonding the magnetic top 5 to the magnetic core 2.

Specifically, the magnetic top 5 is disposed over the top surfaces of the first and second flange sections 21 and 22. An adhesive, for example, thermosetting epoxy adhesive or adhesive that includes magnetic powder, is provided between the magnetic top 5 and the first and second flange sections 21 and 22, and the magnetic top 5 is bonded to the first and second flange sections 21 and 22.

Next, operations and advantages exhibited by the common-mode choke coil according to the present preferred embodiment will be described.

Figure 12:
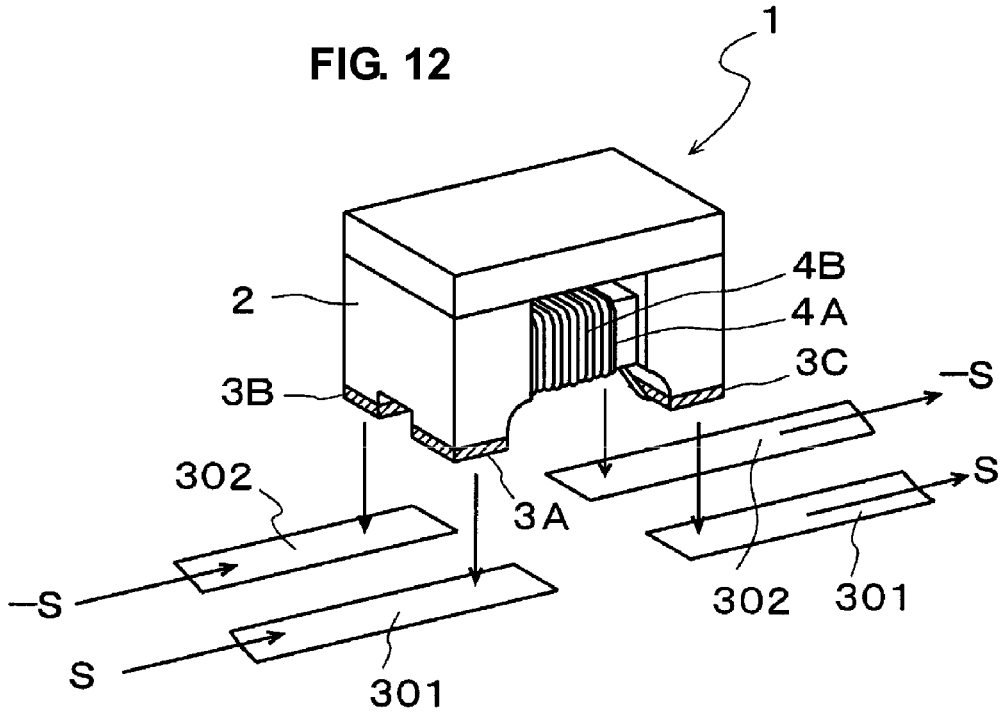
FIG. 12 is a perspective view for describing operations and advantages of the common-mode choke coil.

FIG. 12 is a perspective view to describe the operations and advantages of the common-mode choke coil 1.

As illustrated in FIG. 12, the common-mode choke coil 1 according to the present preferred embodiment can be mounted on differential-signal transmission lines 301 and 302.

When a common-mode noise is input into the common-mode choke coil 1 from the differential-signal transmission lines 301 and 302 through the external electrodes 3A and 3B, the common-mode choke coil 1 functions as an inductor having a high impedance and removes the common-mode noise.

When differential signals S and −S having opposite phases are input from the side of the external electrodes 3A and 3B, the differential signals S and −S input to the external electrodes 3A and 3B are transmitted through the first and second wires 4A and 4B, respectively, and output through the external electrodes 3C and 3D to the differential-signal transmission lines 301 and 302. At this time, because the first and second wires 4A and 4B are wound around the core 2 in close contact with each other in a well-balanced manner, the magnetic coupling between the wires is improved, and the second wire 4B does not suffer from layer-down. Thus, the input differential signals S and −S are output to the differential-signal transmission lines 301 and 302 without being mode-converted to noise. That is, the noise power ratio for noise output from the common-mode choke coil 1 according to the present preferred embodiment is significantly reduced, and outstanding noise reduction is achieved.

The present invention is not limited to the above-described preferred embodiments, and various modifications and changes can be made without departing from the scope of the summary of the invention.

For example, in the above-described preferred embodiments, as a method for winding a wire-wound type coil, the first and second wires 4A and 4B preferably are simultaneously wound around the winding core section 20 and, as illustrated in FIG. 5, the wire portion 4B1 of the first turn of the second wire 4B is also arranged closer to the first flange section 21 than the wire portion 4A1 of the first turn of the first wire 4A. Further, the first and second wires 4A and 4B are wound around the winding core section 20 such that the wire portion 4B1 of the first turn of the second wire 4B is in contact with the wire portion 4A1 of the first turn of the first wire 4A and the first flange section 21. However, it is, of course, noted that, in addition to such a winding method, a winding method of merely simultaneously winding the first and second wires 4A and 4B around the winding core section 20 is included in the scope of the present invention.

In contrast, a method of winding the first and second wires 4A and 4B around the winding core section 20 one by one, not simultaneously, thereby arranging the wire portion 4B1 of the first turn of the second wire 4B at a position closer to the first flange section 21 than the wire portion 4A1 of the first turn of the first wire 4A is while the wire portion 4B1 is in contact with the wire portion 4A1 of the first turn of the first wire 4A and the first flange section 21 to prevent a layer-down is also included in the scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A wire-wound type coil comprising:

a magnetic core including a winding core section and first and second flange sections disposed at both ends of the winding core section;

an external electrode provided on each of the first and second flange sections; and first and second wires wound around the winding core section from a side adjacent to the first flange section toward a side adjacent to the second flange section, each of the first and second wires having an end section extending to the external electrode and bonded thereto; wherein the first wire is directly wound around the winding core section;

the second wire is wound around an outside of the first wire such that a wire portion of the first turn of the second wire is arranged closer to the first flange section than a wire portion of the first turn of the first wire is and is in contact with both the first flange section and the wire portion of the first turn of the first wire;

a wire portion of a last turn of the first wire and a wire portion of a last turn of the second wire terminate before the second flange section without being in contact with the second flange section, and an end section of each of the wire portions of the last turns extends to and is bonded to the external electrode on the second flange section; and the wire portion of the first turn of the second wire, that is arranged closer to the first flange section than the wire portion of the first turn of the first wire, is not in direct contact with the winding core section.

2. The wire-wound type coil according to claim 1, further comprising a magnetic top extending between and fixed to the first and second flange sections.

* * * * *